US005908740A

United States Patent [19]

Maskasky et al.

[11] Patent Number: 5,908,740

[45] Date of Patent: Jun. 1, 1999

[54] PROCESS FOR PREPARING HIGH CHLORIDE (100) TABULAR GRAIN EMULSIONS

[75] Inventors: Joe E. Maskasky; Victor P. Scaccia, both of Rochester, N.Y.

[73] Assignee: Eastman Kodak Company, Rochester, N.Y.

[21] Appl. No.: 08/976,321

[22] Filed: Nov. 21, 1997

[51] Int. Cl.[6] ..... G03C 1/015; G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 5,264,337 | 11/1993 | Maskasky | 430/567 |
| 5,292,632 | 3/1994 | Maskasky | 430/567 |
| 5,320,938 | 6/1994 | House et al. | 430/567 |
| 5,413,904 | 5/1995 | Chang et al. | 430/569 |
| 5,641,620 | 6/1997 | Yamashita et al. | 430/569 |
| 5,663,041 | 9/1997 | Chang et al. | 430/569 |
| 5,665,530 | 9/1997 | Oyamada et al. | 430/567 |
| 5,744,297 | 4/1998 | Chang et al. | 430/567 |

FOREIGN PATENT DOCUMENTS

| | | | |
|---|---|---|---|
| 0 645 670 A1 | 3/1995 | European Pat. Off. | G03C 1/035 |
| 0 670 515 A2 | 9/1995 | European Pat. Off. | G03C 1/015 |

*Primary Examiner*—Mark F. Huff
*Attorney, Agent, or Firm*—Carl O. Thomas

[57] ABSTRACT

A process of preparing a photographically useful high chloride {100} tabular grain emulsion is disclosed that, following grain nucleation, introduces the total silver required for grain growth before undertaking ripening at a temperature of from 60 to 95° C. The advantages attainable include a higher concentration of the silver in the final emulsion and high chloride tabular grains having larger mean grain sizes and higher average aspect ratios and accounting for a higher percentage of total grain projected area.

8 Claims, No Drawings

PROCESS FOR PREPARING HIGH CHLORIDE (100) TABULAR GRAIN EMULSIONS

FIELD OF THE INVENTION

The invention is directed to a process of preparing photographically useful silver halide emulsions. Specifically, the invention relates to an improved process for preparing high chloride {100} tabular grain emulsions.

DEFINITIONS

In referring to grains and emulsions containing two or more halides, the halides are named in order of ascending concentrations.

The term "high chloride" in referring to grains and emulsions indicates that chloride is present in a concentration of greater than 50 mole percent, based on total silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and an aspect ratio of at least 2.

The term "tabular grain emulsion" refers to an emulsion in which tabular grains account for greater than 50 percent of total grain projected area.

The term "{100} tabular" is employed in referring to tabular grains and tabular grain emulsions containing tabular grains having {100} major faces.

The term "gelatino-peptizer" is employed in its art recognized sense to designate gelatin (e.g., cattle bone or hide gelatin), acid-treated gelatin (e.g., pigskin gelatin), or a gelatin derivative (e.g., acetylated or phthlated gelatin).

The term "pAg" is the negative logarithm of silver ion activity. From the equilibrium equation $$-\log Ksp = pAg + pX \quad (I)$$

wherein Ksp is the solubility product constant of silver halide at a stated temperature and pX is the negative logarithm of halide ion activity, it is apparent that specifying temperature and pAg also specifies halide ion activity.

*Research Disclosure* is published by Kenneth Mason Publications, Ltd., Dudley House, 12 North St., Emsworth, Hampshire P010 7DQ, England.

BACKGROUND

There are many reasons for believing high chloride {100} tabular grain emulsions, the invention of Maskasky U.S. Pat. Nos. 5,264,337 and 5,292,632, to be ideal for a variety of photographic applications. Tabular grain emulsions are well known to offer improved sharpness and an improved speed-granularity relationship. Silver chloride emulsions are recognized to be ecologically attractive and to possess the capability of rapid processing. Silver chloride grains with predominantly {100} crystal faces are recognized to have a high degree of shape stability, allowing morphologically stable {100} tabular grains to be formed.

House et al U.S. Pat. No. 5,320,938 disclosed a process of preparing high chloride {100} tabular grain emulsions that employs iodide during grain nucleation. Subsequently Chang et al U.S. Pat. No. 5,413,904 disclosed an improvement in the House et al process resulting from delaying iodide addition in the nucleation step for a short period after initial silver and chloride ion addition.

Japanese origin patent disclosures (e.g., Saitou European patent applications 0 645 670 and 0 670 515 as well as Yamashita et al U.S. Pat. No. 5,641,620 and Oyamada et al U.S. Pat. No. 5,665,530) modified the Chang et al process by substituting bromide for iodide in grain nucleation. These processes for preparing high chloride {100} tabular grain emulsions rely on an AgCI/AgBr/AgCl precipitation sequence (described as creating a "halide gap") during grain nucleation to create the crystal lattice dislocations that promote {100} tabular grain growth. Grain nuclei formation is undertaken at a lower temperature while grain growth is undertaken by adding silver and halide ions as required after raising the temperature of the emulsion containing the grain nuclei. It is also taught to employ during grain nucleation a gelatin peptizer containing at least 10 micromoles of methionine per gram of gelatin.

RELATED APPLICATION

Chang et al U.S. Ser. No. 08/975,906, concurrently filed and commonly assigned, titled A SIMPLIFIED NUCLEATION OF HIGH CHLORIDE TABULAR GRAIN EMULSIONS, discloses a simplification of the nucleation processes of the Japanese origin patent disclosures, cited above, in that high bromide silver halide nuclei are employed rather than employing a three step precipitation sequence to create a "halide gap".

SUMMARY OF THE INTENTION

In one aspect, this invention is directed to a process of precipitating a photographically useful emulsion containing silver halide grains comprised of bromide and at least 50 mole percent chloride, based on silver, with tabular grains having {100} major faces accounting for greater than 50 percent of total grain projected area, comprised of the steps of (1) providing in a reaction vessel at a temperature of from 35 to 50° C. an emulsion comprised of (a) an aqueous dispersing medium containing a gelatino-peptizer and having a pH of from 3.5 to 7.0 and a pAg of from 5.5 to 8.0 and (b) from 1 to 10 percent of total silver in the photographically useful emulsion in the form of silver halide grain nuclei containing bromide to promote {100} tabular grain growth, (2) creating a second silver halide grain population within the dispersing medium by completing addition of silver forming the photographically useful emulsion while adding halide ion to maintain a pAg in the range of from 5.5 to 8.0, the halide ion being greater than 50 mole percent chloride, based on silver, total volume being limited to 0.7 to 2.0 liters per silver mole, and (3) thereafter increasing the temperature of the dispersing medium to 60 to 95° C. to ripen out grains of the second grain population, thereby growing the tabular grains having {100} major faces.

It has been discovered quite surprisingly that this modified technique for growing high chloride {100} tabular grain emulsions allows a variety of improvements in the completed emulsions to be realized. As demonstrated in the Examples below, advantages attainable include a higher concentration of the silver in the emulsion at the conclusion of the grain growth step. The high chloride {100} tabular grains have larger mean grain sizes and higher average aspect ratios. The {100} tabular grains can also account for a higher percentage of total grain projected area, and this advantage is increased when gelatino-peptizer is present during grain nucleation that contains at least 40 micromoles of methionine per gram.

Finally, contrary to the teachings of Japanese origin patent disclosures, cited above, the reduction of methionine below 10 micromoles per gram in the gelatino-peptizer during the grain nucleation step is advantageous. To the extent that the methionine content of the gelatino-peptizer employed in grain nucleation and growth is reduced, the rate of grain ripening is increased, resulting in shorter overall precipitation times.

DESCRIPTION OF PREFERRED EMBODIMENTS

The present invention is directed to a process of preparing a photographically useful emulsion containing silver halide grains comprised of bromide and greater than 50 mole percent chloride, with tabular grains having {100} major faces accounting for greater than 50 percent of total grain projected area. The process of precipitation requires three sequential steps: (1) forming or providing a grain nuclei population as a starting emulsion, (2) a renucleation step in which a second grain population is created, and (3) a ripening step in which the high chloride {100} tabular grains are grown from grain nuclei hosts while the second grain population acts as the source of silver halide for tabular grain growth.

The process requires bromide incorporation at the grain nucleation site. Bromide can be present elsewhere in the grain, but is not required. The process is initiated by creating silver bromide containing grain nuclei that promote the growth of high chloride {100} tabular grains. The grain nuclei account for 1 to 10 (preferably 3 to 8) percent of total silver present at the conclusion of grain growth. The grain nuclei can be prepared as taught by the Examples of Yamashita et al U.S. Pat. No. 5,641,620 or Oyamada et al U.S. Pat. No. 5,665,530, the disclosures of which are here incorporated by reference. According to these teachings silver chloride is precipitated during formation of the grain nuclei and the concentration of bromide is, after an initial delay, increased and then decreased. This creates a "halide gap" that introduces the crystal lattice dislocations responsible for subsequently promoting {100} tabular grain growth. The General Nucleation Procedure of the Examples further illustrates the halide gap nuclei formation technique.

A preferred technique for creating grain nuclei containing a halide gap, where bromide ion is employed to create the halide gap, involves first step (a) of precipitating from 5 to 90, preferably 10 to 50, percent of total silver forming the grain nuclei. In this first precipitation the grains formed contain less than 10 mole percent bromide, based on silver, and are free of iodide. Step (a) is followed by step (b), wherein bromide ion is added without further silver ion addition. The bromide ion accounts for from 1 to less than 50 (preferably 5 to 25) mole percent, based on silver added in step (a). After allowing the bromide ion introduced to effect a halide conversion of the grains formed in step (a), a third step (c) is undertaken in which the remainder of the silver forming the grain nuclei is introduced. The halide ion introduced in step (c) is less than 20 (preferably less than 10) mole percent bromide, based on silver introduced during this step. The balance of the halide ion introduced is chloride. No iodide is introduced in step (c). Steps (a), (b) and (c) can be performed under conventional precipitation conditions, but are preferably performed within the parameter limits the emulsion containing the grain nuclei is required to satisfy, set out below.

Although it is known that the introduction of iodide at or immediately following grain nucleation can create grain nuclei that promote the growth of high chloride {100} tabular grains, the process of the invention has not been found compatible with grain nuclei that rely on iodide for the crystal lattice dislocations that promote {100} tabular grain growth. It is therefore contemplated to exclude iodide concentrations that create crystal lattice dislocations that promote {100} tabular grain growth. Preferably iodide is entirely excluded from grain nucleation.

Instead of creating the grain nuclei by the halide gap technique taught by Yamashita et al and Oyamada et al, it is alternatively contemplated to employ a simplified technique, which forms high bromide grain nuclei, which is taught by Chang et al, concurrently filed and cited above. According to this technique, during the grain nucleation step grain nuclei are formed that contain greater than 50 mole percent bromide, based on silver, and preferably consist essentially of silver bromide. The grain nuclei are preferably regular grains and preferably monodisperse, exhibiting a grain size coefficient of variation (COV) of less than 25 percent and, optimally, less than 15 percent.

The high bromide grain nuclei process differs from that of Yamashita et al and Oyamada et al in that it is unnecessary to build any crystal lattice dislocations into the grain nuclei, since the necessary crystal lattice dislocations are created when the first subsequent grain growth occurs depositing silver halide that contains more than 50 mole percent chloride, based on silver. Thus, this technique allows any conventional high bromide regular grain population to serve as grain nuclei and thereby simplifies the step of forming grain nuclei.

The emulsion containing the grain nuclei can be transferred from the reaction vessel in which it is formed to a larger reaction vessel for the subsequent step of grain growth. Alternatively, precipitation can continue following grain nuclei formation in the original reaction vessel.

Before proceeding to the renucleation and ripening steps in which high chloride {100} grains are grown, the emulsion is brought within certain parameter limits, if they are not already satisfied. The temperature of the emulsion in the reaction vessel is adjusted to the range of from 35 to 50° C. pH is adjusted to the range of from 3.5 to 7 (preferably from 5.0 to 6.5). pH adjustment can be accomplished by employing a base, such as an alkali hydroxide, or a mineral acid, such as $HNO_3$. If desired, a buffering agent can be introduced to increase the ease of maintaining the emulsion within the indicated pH range.

The pAg of the dispersing medium containing the grain nuclei emulsion is adjusted to lie within the range of form 5.5 to 8.0, preferably 6.4 to 7.5. pAg is regulated by adding either silver ion (e.g., silver nitrate in solution) or halide ion (e.g., alkali halide in solution).

Gelatino-peptizer at the conclusion of step (1) is preferably in the range of from 0.5 to 60 grams per mole of silver present at the conclusion of step (2). Any conventional gelatino-peptizer can be employed. Various conventional forms of gelatino-peptizers are illustrated by *Research Disclosure*, Vol. 38957, Sep. 1996, Item 38957, Section II. Vehicles, vehicle extenders, vehicle-like addenda and vehicle related addenda, A. Gelatin and hydrophilic colloid peptizers, particularly paragraphs (1) to (3). A more extensive discussion of gelatin and its properties is provided by James *The Theory of the Photographic Process*, 4th Ed., Macmillan, New York, 1977, Chapter 2, Gelatin. Any of the varied forms of gelatino-peptizers disclosed by Yamashita et al and Oyamada et al, cited and incorporated by reference above, can be employed.

It is specifically contemplated to employ gelatino-peptizers that contain natural levels of methionine, which are typically between 40 and 60 micromoles per gram. The presence during grain nucleation of gelatino-peptizer that contains at least 40 micromoles of methionine per gram has been observed to result in high chloride {100} tabular grains accounting for a higher proportion of total grain projected area. Preferred concentrations of gelatino-peptizer that contains at least 40 micromoles of methionine per gram during the grain nuclei formation step are in the range of from 0.5 to 5.0 grams per mole of silver present at the completion of the renucleation step.

Alternatively gelatino-peptizer can be employed that has been treated with an oxidizing agent (e.g., hydrogen peroxide) to reduce methionine levels. It is specifically contemplated to employ gelatino-peptizer that contains less than 10 micromoles of methionine per gram. It has been discovered quite unexpectedly that the selection of gelatino-peptizer from which methionine has been substantially eliminated (reduced to less than 4 micromole per gram) allows more rapid completion of the grain ripening step, discussed below. This effect is not, however, limited to employing gelatino-peptizer containing less than 4 micromole of methionine per gram during formation of the grain nuclei, but can also be realized when low methionine gelatino-peptizer is added immediately prior to or during grain renucleation. Preferred concentrations of gelatino-peptizer that contains less than 4 micromoles of methionine per gram during the grain nuclei formation step are in the range of from 1.0 to 60.0 grams per mole of silver present at the completion of the grain renucleation step.

To achieve the highest possible percent of total grain projected area accounted for by tabular grains while also achieving a rapid rate of grain ripening, it is preferred to employ a gelatino-peptizer containing at least 40 micromoles methionine per gram during formation of the grain nuclei, subsequently adding gelatino-peptizer that contains less than 4 micromoles methionine per gram immediately prior to or during grain growth.

Although the temperature, pH, pAg, and gelatino-peptizer selections noted above are only required to be created before commencement of the {100} tabular grain growth step, it is preferred that these parameters be satisfied throughout formation of the grain nuclei.

With the grain nuclei emulsion satisfying the temperature, pH, pAg, and gelatino-peptizer parameters indicated above, the growth of high chloride {100} tabular grains is initiated by a renucleation step, wherein the balance of the silver and halide ion to be incorporated in the photographically useful emulsion is introduced. The silver ion introduced accounts for from 90 to 99 (preferably 92 to 97) percent of total silver in the photographically useful emulsion. Halide ion is introduced as required to maintain a pAg in the range of from 5.5 to 8.0, preferably from 6.4 to 7.5.

Preferably silver ion is introduced in the renucleation step in the form of any convenient conventional soluble salt solution—e.g., a silver nitrate salt solution. Similarly, the halide ion is introduced in the form of any convenient conventional soluble salt solution—e.g., an alkali halide salt solution). Alternatively the silver and halide ions can be introduced in the form of a fine grain emulsion. For example, when chloride is the sole halide in the fine grains, these grains can be easily ripened out in grain sizes of up to 0.20 μm mean ECD. Fine bromo chloride grains containing just greater than 50 mole percent chloride, based on silver, can be easily ripened out in grain sizes of up to 0.10 μm mean ECD.

One of the surprising advantages that has been realized is that more concentrated emulsions can be prepared by silver and halide ion addition according to the invention. The concentrations of the silver and halide ions introduced in the addition are regulated to create a total volume of emulsion in the range of from 0.7 to 2.0 liters per silver mole. The advantage of limiting the volume of the emulsion in relation to the silver ion is that the emulsion generating capacity of the reaction vessel is increased.

The halide introduced during the grain renucleation step is chosen so that chloride accounts for greater than 50 mole percent, based on silver, of total halide in the reaction vessel. Preferably chloride is added as the sole halide during the, renucleation step. Since only very small concentrations of bromide are required for initial grain nucleation, it is appreciated that the chloride concentration at the conclusion of the renucleation step can exceed 99 mole percent, based on silver. The balance of the halide not accounted for by chloride, if any, added during the growth step is preferably bromide. It is preferred to avoid the introduction of iodide ion during the renucleation step, although significant concentrations of iodide can be added later in the subsequent ripening step, if desired.

More gelatino-peptizer can be, added during the renucleation step, if necessary. The concentration of gelatino-peptizer employed to peptize the emulsion being formed through the growth step ranges from 10 to 60 grams per mole of silver present at the conclusion of the renucleation step. Thus, it is apparent that, when the gelatin containing less than 4 micromoles per gram of methionine is employed during grain nuclei formation, gelatin concentrations can be employed that allow grain renucleation to be completed without further gelatino-peptizer addition. As previously indicated, when gelatino-peptizer containing at least 40 micromoles of methionine per gram is employed during formation of the grain nuclei, it is advantageous to incorporate additional gelatino-peptizer containing less than 4 micromoles of methionine per gram during the renucleation step to reduce the time required for ripening. Both forming grain nuclei and performing the renucleation step in the presence gelatino-peptizer that contains less than 4 micromoles methionine per gram is particularly advantageous in that rapid rates of ripening can be realized without further gelatino-peptizer addition, thereby simplifying the preparation process.

The addition of halide ion and the balance of the silver ion during 10 the renucleation step creates a second grain population within the dispersing medium. Growth of the high chloride {100} tabular grains is driven by temperature as the ripening out of the second grain population occurs, thereby redepositing the silver halide from the second grain population onto the grain nuclei that contain crystal lattice dislocations favorable for {100} tabular grain growth. Ideally the ripening out process is terminated as the last remaining grains of the second grain population are ripened out. If ripening is continued beyond this point, the corners of the high chloride {100} tabular grains become progressively more rounded and the tabular grains increase in thickness. Corner rounding is common in high chloride {100} tabular grain emulsions and is not objectionable in the process. Hence the termination of ripening is dictated by the maximum thickness of the tabular grains that can be tolerated for the intended photographic application. It is preferred as a practical matter to discontinue grain ripening just after depleting the second grain population.

To facilitate ripening of the second grain population and hence growth of the high chloride {100} tabular grains, the temperature of the dispersing medium is increased following the renucleation step. A temperature in the range of from 60 to 95° C. (preferably 65 to 85° C.) is contemplated. The purpose of raising the temperature is to accelerate the rate of ripening. At temperatures below 60° C. the rate of ripening is unacceptably slow.

Raising the temperature of the emulsion changes only slightly the potential difference between a sensing and reference electrode pair of the type employed in the Examples below. It does, however, change the solubility product constant, Ksp, of silver chloride, resulting in a change in pAg. For example, a pAg at 40° C. of 5.5 translations to a pAg of 5.1 at 60° C., a pAg of 4.8 at 85° C., and a pAg of 4.6 at 95° C., while a pAg at 40° C. of 8.0 translations to a pAg of 7.5 at 60° C., a pAg of 7.0 at 85° C., and a pAg of 6.8 at 95° C.

When the temperature of the emulsion is raised to accelerate ripening, maintaining a vAg in the range of from 105 to 140 mV (employing electrodes described in the Examples) increases the rate of ripening, with the rate of ripening increasing as vAg decreases. Thus, employing a gelatino-peptizer containing less than 4 micromoles of methionine per gram in a dispersing medium maintained at a vAg of from 120 to 140 mV and at an elevated temperature, as noted above, results in the most accelerated rates of ripening.

Whereas Yamashita et al and Oyamada et al, cited above, introduce silver and halide ion consumed during grain growth following temperature elevation to drive ripening, it has been discovered quite surprisingly that superior high chloride {100} tabular grain characteristics are realized when silver ion addition is completed prior to elevating temperature to drive grain ripening.

It is, in fact, preferred to introduce all of the silver ion into the dispersing medium before any substantial growth of the grain nuclei can occur. Thus, rapid silver and halide ion additions preceding raising the temperature of the dispersing medium are preferred. So called "dump" additions are preferred—that is, the rate of addition is the maximum that the operating equipment will permit and is not intentionally limited. Completion of silver ion addition in less than 15 minutes is contemplated.

The high chloride {100} tabular grain emulsions obtained at the conclusion of the ripening step contain greater than 50 mole percent chloride, preferably at least 70 mole chloride, and optimally at least 90 mole percent chloride, based on silver. Bromide preferably accounts for the balance of the halide.

Although iodide ion is either absent or limited in the earlier stages of emulsion preparation, as indicated above, it is possible to incorporate significant iodide concentrations in the latter stages of ripening. Alternatively, after the ripening process described above is completed without iodide addition, iodide can be incorporated in a subsequent conventional step of grain growth involving iodide ion addition and further ripening or by the introduction of additional silver and halide ion, including iodide ion. Iodide levels are preferably limited to less than 10 (most preferably less than 5) mole percent, based on silver. Since iodide is known to limit processing rates, one of generally sought advantages of employing high chloride emulsions, it is preferred that the grains be substantially free of iodide. It is, in fact, an advantage of the present invention that no iodide is required to form a high chloride {100} tabular grain emulsion.

It is recognized in the art that introducing crystal lattice dislocations at the edge of tabular grains increases their speed without increasing their granularity. Tabular grains emulsions that contain peripheral crystal lattice dislocations are disclosed by Wilgus et al U.S. Pat. No. 4,434,226, Kofron et al U.S. Pat. No. 4,439,520, Solberg et al U.S. Pat. No. 4,433,048, Ikeda et al U.S. Pat. No. 4,806,461, Takahara et al U.S. Pat. No. 5,068,173, Haga et al U.S. Pat. No. 5,472,836, Suga et al U.S. Pat. No. 5,550,012, and Maruyama et al U.S. Pat. No. 5,550,014, the disclosures of which are here incorporated by reference. The addition of iodide ion at the late stages of ripening, preferably when less than 20 (preferably<10) percent but at least 0.5 (preferably 1.0) percent of total silver remains in the second grain population, is capable of increasing the speed of the emulsions obtained at the conclusion of ripening. It is contemplated to release iodide ion in the dispersing medium during ripening by adding elemental iodine, as disclosed in Maskasky et al U.S. Ser. No. 08/955,867, filed Oct. 21, 1997, commonly assigned, titled HIGH CHLORIDE TABULAR GRAIN EMULSIONS AND PROCESSES FOR THEIR PREPARATION. Alternatively, iodide ion can be released in the dispersing medium during ripening by adding an organic iodide ion source compound with a maximum second order reaction rate constant of less than $1\times10^3$ $mole^{-1}$ $sec^{-1}$, as disclosed in Maskasky et al U.S. Ser. No. 08/961,962, filed Oct. 31, 1997, commonly assigned titled A PROCESS OF PREPARING HIGH CHLORIDE {100} TABULAR GRAIN EMULSIONS. Specific illustrations of organic iodide ion source compounds are provided by Suga et al and Takahara et al.

The high chloride {100} tabular grain emulsions produced by the process of the invention can satisfy known grain characteristics, such as mean ECD, average tabular grain thicknesses, average tabular grain aspect ratios and percent total grain projected area accounted for by {100} tabular grains. Typically the mean ECD of the photographically useful product emulsions is less than about 5 μm and most typically in the range of from about 0.3 to 3.0 μm. The tabular grains are contemplated to have thicknesses less than 0.3 μm and preferably less than 0.2 μm.

It is generally preferred that the {100} tabular grains account for the highest attainable percent of total grain projected area. It is preferred that the {100} tabular grains at the conclusion of the ripening step account for at least 70 percent and optimally at least 90 percent of total grain projected area.

Once formed, the high chloride {100} tabular grain emulsions can be sensitized, combined with conventional photographic addenda, and coated in any conventional manner, as is further illustrated by the following patents disclosing high chloride tabular grain emulsions and their use, here incorporated by reference:

| | |
|---|---|
| Maskasky | U.S. Pat. No. 5,264,337; |
| Maskasky | U.S. Pat. No. 5,275,930; |
| Maskasky | U.S. Pat. No. 5,292,632; |
| Brust et al | U.S. Pat. No. 5,314,798; |
| House et al | U.S. Pat. No. 5,320,938; |
| Szajewski et al | U.S. Pat. No. 5,356,764; |
| Oikawa | U.S. Pat. No. 5,654,133; |
| Chang et al | U.S. Pat. No. 5,413,904; |
| Budz et al | U.S. Pat. No. 5,451,490; |
| Olm et al | U.S. Pat. No. 5,457,021; |
| Brennecke | U.S. Pat. No. 5,498,518; |
| Yamashita | U.S. Pat. No. 5,565,315; |
| Saitou et al | U.S. Pat. No. 5,587,281; |

-continued

| | |
|---|---|
| Oyamada | U.S. Pat. No. 5,593,821; |
| Yamashita et al | U.S. Pat. No. 5,641,620; |
| Yamashita et al | U.S. Pat. No. 5,652,088; |
| Saitou et al | U.S. Pat. No. 5,652,089; |
| Oikawa | U.S. Pat. No. 5,654,133; and |
| Chang et al | U.S. Pat. No. 5,663,041. |

Generally preparing the emulsions for use following precipitation begins with emulsion washing. This is in turn followed by chemical and spectral sensitization. Antifoggant and stabilizer addition is usually also undertaken. The emulsions are also combined with additional levels of vehicle before coating. Hardener is added to one or more vehicle layers just before coating. The emulsions are contemplated for use in both black-and-white (silver image forming) and color (dye image forming) photographic elements. The emulsions can be incorporated in radiographic and black-and-white photographic elements. The emulsions can also be incorporated in color print, color negative or color reversal elements. The following paragraphs of *Research Disclosure*, Vol. 389, September 1996, Item 38957, illustrate conventional photographic features compatible with the emulsions of the invention:

I. Emulsion grains and their preparation E. Blends, layers and performance categories II. Vehicles, vehicle extenders, vehicle-like addenda and vehicle related addenda III. Emulsion washing IV. Chemical sensitization V. Spectral sensitization and desensitization VII. Antifoggants and stabilizers IX. Coating physical property modifying addenda X. Dye image formers and modifiers XI. Layer arrangements XV. Supports XVIII. Chemical development systems

EXAMPLES

The invention can be better appreciated by reference to the following specific examples. References to "high methionine" gelatin indicate a methionine content of 58 micromoles per gram. References to "low methionine" gelatin indicate that the high methionine gelatin was treated with hydrogen peroxide to reduce its methionine content to 0.1 micromole per gram.

vAg was determined during emulsion preparation starting with a standard reference electrode (Ag/AgCl with 4 molar KCl at room temperature) in a 4 molar KCI salt bridge and an anodized Ag/AgCl indicator electrode. pAg was calculated from vAg measurements.

Examples 1 through 6

These examples practiced grain nuclei formation in the presence of high methionine gelatin.

Examples 1 through 4

Examples 1 through 4 employed low methionine gelatin for grain growth.

General Nucleation Procedure

A vigorously stirred reaction vessel containing 2400 mL of a solution which contained 10 g of deionized high methionine bone gelatin (58 $\mu$mole methionine per g gelatin) and 0.014M in NaCl was adjusted to pH 4.0 at 40° C. (See Optimal pH Determination given below.) To this solution at 40° C. were added simultaneously for 15 sec, 1.25M $AgNO_3$ solution and 1.27M NaCl solution at a rate of 120 mL per min. The mixture then was held for 2 min then 50 mL of 0.10M NaBr solution was added at a rate of 100 mL per min followed by another 2 min hold. Then the $AgNO_3$ and NaCl solutions were simultaneously added at 120 mL per min for 1 min. After a 2 min hold, the pH was adjusted to 5.50 at 40° C. with dilute NaOH solution.

Optimal pH Determination (nucleation and growth)

The above General Nucleation Procedure was performed using 50 g of high methionine bone gelatin at nucleation pH's of 5.5, 4.5, 4.2, 4.0, and 3.0. Then after the pH adjustment to 5.50, the five emulsions were heated to 70° C. and stirred at this temperature for 30 min.

The final five seed emulsions had the following % of projected area as tabular grain nuclei, and average tabular grain nuclei thickness: pH 5.5, 50%, 00.11 $\mu$n; pH 4.5, 85%, 0.09 $\mu$m; pH 4.2, 85%, 0.08 $\mu$m; pH 4.0, 90%, 0.08 $\mu$m; and pH 3.0, 70%, 0.08 $\mu$m. The optimal nucleation was at a pH range of from 3.5 to 4.5.

To determine the optimal growth pH, an emulsion was nucleated using 50 g of high methionine gelatin using the General Nucleation Procedure given above, then it was split into 9 portions. The pH of each portion was adjusted (pH 3.0, 3.5, 4.0, 4.5, 5.0, 5.2, 5.5, 6.0, and 6.5), then heated to 65° C. Samples were removed at 15, 25, 35, and 55 min of heating at 65° C. and examined for the rate of ripening into tabular grain nuclei. The optimal ripening was at a pH of at least 4.5.

Example 1

This example demonstrates making a high aspect ratio (20) tabular grain emulsion having high yield per unit volume (1.3 liters of emulsion per mole Ag).

Immediately after the above nucleation procedure, 500 mL of a 26% low methionine gelatin solution (0.1 Ipmole methionine per g gelatin) was added and the pH was adjusted to 5.50. Then at 40° C., 4.0M $AgNO_3$ solution was added at 120 mL per min (~0.2 mole Ag per L of emulsion per min) while maintaining the pH at 5.50 and the silver ion potential (vAg) at 155 mV (pAg=7.19) by the concurrent addition of 4.0M NaCl solution. When 1 L of the 4M $AgNO_3$ solution had been added, the additions were stopped. The mixture was heated to 75° C. at the rate of 1.7° C. per min and the vAg was maintained at 155 mV by the addition of NaCl solution and the pH was maintained at 5.5. The emulsion was held at 75° C. for 210 min, the minimum time needed to ripen away the fine grain population.

The resulting high chloride emulsion was comprised of tabular grains having {100} major faces which made up 95% of the projected area of the total grain population. This tabular grain population had an average ECD of 3.0 $\mu$m and an average thickness of 0.15 $\mu$m. The average aspect ratio was 20. The yield per unit volume of unwashed emulsion was 1.3 liters of emulsion per mole Ag.

The results are summarized in Table I.

Comparison Example 2

This comparison example shows the result of heating the emulsion prior to the addition of growth silver. The resulting emulsion tabular grains were thicker (0.33 $\mu$m) and of lower aspect ratio (8).

This emulsion was made similarly to that of Example 1, except that after the nucleation procedure, the mixture was heated from 40° C. to 75° C. at a rate of 3.3° C. per min while maintaining a vAg of 155 mV by slowly adding 4M NaCl solution and maintaining a pH of 5.5. The mixture was stirred for 30 min at 75° C. to form the tabular grain nuclei, then the temperature was reduced to 40° C. in 6 min. At 40° C., 500 mL of a 26% low methionine gelatin solution was added and the pH adjusted to 5.50. Then 4.0M $AgNO_3$ and 4.0M NaCl solutions were added followed by a temperature increase to 75° C. as in Example 1. Then the emulsion was held at 75° C. for 30 min, the minimum time needed to ripen away the fine grain population.

The results are summarized in Table I.

Example 3

This example shows that by adding chloride during the final ripening, the emulsion making time can be reduced (155 min) while maintaining a high tabular grain projected area (95%) but resulting in thicker (0.17 μm) tabular grains compared to Example 1.

This emulsion was made similarly to that of Example 1, except that when the emulsion reached 75° C., 4M NaCl solution was added to change the vAg from 155 mV to 130 mV (pAg=6.79) at the rate of 2 mV per min and then held at this vAg for 105 min, the minimum time needed to ripen away the fine grain population.

The results are given in Table I.

Comparison Example 4

This comparison shows the result of varying Example 3 by heating the emulsion before adding growth silver. The resulting emulsion tabular grains were thicker (0.29 μm), lower in aspect ratio (7), and lower in projected area (85%).

This emulsion was made similarly to that of Example 3, except that after the nucleation procedure, the mixture was heated from 40° C. to 75° C. at a rate of 3.3° C. per min while maintaining a pH of 5.5, and a vAg of 155 mV by adding 4 M NaCl solution. The mixture was stirred for 30 min at 75° C. to form the tabular grain nuclei, then the temperature was reduced to 40° C. in 6 min. At 40° C., 500 mL of a 26% low methionine gelatin solution was added and the pH adjusted to 5.50. Then 4.0M $AgNO_3$ and 4.0M NaCl solutions were added followed by a temperature increase to 75° C. as in Example 3. Then the emulsion was held at 75° C., 130 mV for 20 min, the minimum time needed to ripen away the fine grain population.

The results are summarized in Table I.

Examples 5 and 6

These emulsions were made using high methionine gelatin for both grain nucleation and for growth.

Example 5

This example demonstrates making a high aspect ratio (12) tabular grain emulsion and in high yield per unit volume (1.3 liters of emulsion per mole Ag).

A vigorously stirred reaction vessel containing 2400 mL of a solution which contained deionized high methionine bone gelatin (58 μmole methionine per g gelatin) and 0.014M in NaCl was adjusted to pH 4.0 at 40° C. To this solution at 40° C. were added simultaneously for 15 sec, 1.25M AgNO3 solution and 1.27M NaCl solution at a rate of 120 mL per min. The mixture was stirred for 2 min, then 50 mL of 0.10M NaBr solution was added at a rate of 100 mL per min followed by another 2 min hold. Then the $AgNO_3$ and NaCl solutions were simultaneously added at 120 mL per min for 1 min. After a 2 min hold, the pH was adjusted to 5.50 at 40° C. with dilute NaOH solution.

Immediately after the above nucleation procedure using 10 g of gelatin, 500 mL of a 26% high methionine gelatin solution was added and the pH was adjusted to 5.50. Then at 40° C., 4.0M $AgNO_3$ solution was added at 120 mL per min (~0.2 mole Ag per L of emulsion per min) while maintaining a pH of 5.50 and a vAg of 155 mV by the concurrent addition of 4.0M NaCl solution. When 1 L of the 4M $AgNO_3$ solution had been added, the additions were stopped. The mixture was heated to 75° C. at the rate of 1.7° C. per min and the vAg was maintained at 155 mV by the addition of NaCl solution and the pH was maintained at 5.5. When the emulsion reached 75° C., 4M NaCl solution was added to change the vAg from 155 mV to 130 mV at a rate of 2 mV per min and then held at this vAg for 135 min, the minimum time needed to ripen away the fine grain population.

The results are summarized in Table I.

Comparison Example 6

This comparison demonstrates heating the emulsion before the addition of growth silver. The resulting emulsion tabular grains were thicker (0.25 μm), of lower aspect ratio (9), and required a longer making time (264 min) than that of Example 5.

This emulsion was made similarly to that of Example 5, except that after the nucleation procedure and the addition of the 500 mL of 26% gelatin solution, the mixture was heated from 40° C. to 75° C. at a rate of 3.3° C. per min while maintaining a pH of 5.5 and a vAg of 155 mV by adding 4M NaCl solution. After holding at 75° C. for 10 min to form the tabular grain nuclei, the mixture was cooled to 40° C. in 4 min. Then 4.0M $AgNO_3$ and 4.0M NaCl solutions were added followed by a temperature increase to 75° C. as described in Example 5. The emulsion was held at a vAg of 130 mV at 75° C. for 180 min, the minimum time needed to ripen away the fine grain population.

The results are summarized in Table I.

TABLE I

| Example (Comparison) | Seed ripening time at elevated temp prior to growth (min at °C.) | Temp at start of growth Ag addition (°C.) | Total make time (min) | Yield (liters of emulsion per mole Ag) | Average ECD (μm) | Average thickness (μm) | Average aspect ratio | Tabular Grain % of Total Projected Area |
|---|---|---|---|---|---|---|---|---|
| Ex. 1 | none | 40 | 247 | 1.3 | 3.0 | 0.15 | 20 | 95 |
| (Comp.2) | 30 at 75 | 40 | 114 | 1.3 | 2.7 | 0.33 | 8 | 85 |
| Ex. 3 | none | 40 | 155 | 1.3 | 2.2 | 0.17 | 13 | 95 |
| (Comp.4) | 30 at 75 | 40 | 116 | 1.3 | 2.1 | 0.29 | 7 | 85 |
| Ex.5 | none | 40 | 185 | 1.3 | 2.0 | 0.17 | 12 | 93 |
| (Comp. 6) | 10 at 75 | 40 | 264 | 1.3 | 2.2 | 0.25 | 9 | 87 |

Examples 7 through 10

Each of these examples employed low metbionine gelatin in forming the grain nuclei. Except for substituting low methionine gelatin and maintaining a dispersing medium pH of 3.0, the same General Nucleation Procedure was employed. Using the Optimum pH Determination described above with low methionine gelatin, the optimum pH at nucleation was at least 2.0, but less than 4.0, and during ripening optimum pH was determined to be at least 3.5.

Example 7

This example demonstrates making a high aspect ratio (15) tabular grain emulsion having a high yield per unit volume (1.1 liters of emulsion per mole Ag).

Two minutes after the nucleation, 4.0M $AgNO_3$ solution was added at 120 mL per min (~0.2 mole Ag per min per L of emulsion) at 40° C. while maintaining a pH of 5.50 and a silver ion potential (vAg) of 155 mV by the concurrent addition of 4.0M NaCl solution. When 1 L of 4M $AgNO_3$ solution had been added, the additions were stopped. The mixture was heated to 55° C. at a rate of 1.7° C. per min then to 75° C. at a rate of 1° C. per min and the vAg was maintained at 155 mV by the addition of NaCl solution and the pH at 5.5. The emulsion was stirred at 75° C. for 90 min, the minimum time needed to ripen away the fine grain population.

The resulting high-chloride emulsion consisted of tabular grains having {100} major faces which made up 85% of the projected area of the total grain population. This tabular grain population had an average equivalent circular diameter of 1.8 μm and an average thickness of 0.12 μm. The average aspect ratio was 15. The yield per unit volume of unwashed emulsion was 1.1 liters of emulsion per mole Ag.

The results are summarized in Table II.

Comparison Example 8

This comparison demonstrates heating the emulsion before the addition of growth silver. The resulting emulsion tabular grains were thicker (0.22 μm) and of lower aspect ratio (11).

This emulsion was made similarly to that of Example 7, except that following the nucleation procedure, the mixture was heated from 40° C. to 75° C. at a rate of 1.7° C. per min while maintaining a pH of 5.5, and vAg of 155 mV by adding a small amount of 4M NaCl solution. The mixture was stirred for 15 min at 75° C. to form the tabular grain nuclei. It was then cooled to 40° C. in 4 min. At 40° C., 4.0M $AgNO_3$ and 4.0M NaCl solutions were added and the temperature increased 75° C., as in Example 7. The emulsion was held at 75° C. for 45 min, the minimum time needed to ripen away the fine grain population.

The results are summarized in Table II.

Example 9

This example shows that by adding chloride during the final ripening, the emulsion make time can be reduced (110 min) from that of Example 7, but thicker tabular grains resulted (0.14 μm).

This emulsion was made similarly to that of Example 7, except that 10 min after the emulsion reached 75° C., 4M NaCl solution was added to change the vAg from 155 mV to 120 mV at the rate of 2 mV per min and then held at 120 mV for 35 min, the minimum time needed to ripen away the fine grain population. Ripening at this low vAg of 120 mV (pAg=6.94) resulted in significant rounding of the tabular grain corners not observed at higher vAg's.

The results are summarized in Table II.

Example 10

This example shows a reduction in total making time (86 min) with only a small loss in yield (1.3 liters of emulsion per mole Ag) compared to Example 7.

Two minutes after the nucleation procedure, 4.0M $AgNO_3$ solution was added at 120 mL per min at 40° C. while maintaining a pH of 5.50, and a vAg of 155 mV (pAg=7.19) by the concurrent addition of 4.0M NaCl solution. The additions were stopped when 750 mL of the 4M $AgNO_3$ solution had been added. The temperature was increased to 75° C. at a rate of 3.3° C. per min while maintaining the vAg at 155 mV by the addition of NaCl solution and the pH at 5.5. When 75° C. was reached, the vAg was adjusted to 140 mV (pAg=6.65) and held at 75° C. for 60 min, the minimum time needed to ripen away the fine grain population.

The results are summarized in Table II.

TABLE II

| Example (Comparison) | Seed ripening time at elevated temp prior to growth (min at °C.) | Temp at start of growth Ag addition (°C.) | Total make time (min) | Yield (liters of emulsion per mole Ag) | Average ECD (μm) | Average thickness (μm) | Average aspect ratio | Tabular Grain % of Total Projected Area |
|---|---|---|---|---|---|---|---|---|
| Ex.7 | none | 40 | 147 | 1.1 | 1.8 | 0.12 | 15 | 85 |
| (Comp.8) | 15 at 75 | 40 | 132 | 1.1 | 2.4 | 0.22 | 11 | 85 |
| Ex.9 | none | 40 | 110 | 1.1 | 1.8 | 0.14 | 13 | 85 |
| Ex.10 | none | 40 | 86 | 1.3 | 1.7 | 0.12 | 14 | 85 |

The invention has been described in detail with particular reference to preferred embodiments thereof, but it will be understood that variations and modifications can be effected within the spirit and scope of the invention.

What is claimed is:

1. A process of precipitating a photographically useful emulsion containing silver halide grains comprised of bromide and at least 50 mole percent chloride, based on silver, with tabular grains having {100} major faces accounting for greater than 50 percent of total grain projected area, comprised of the steps of (1) providing in a reaction vessel at a temperature of from 35 to 50° C. an emulsion comprised of (a) an aqueous dispersing medium containing a gelatino-peptizer and having a pH of from 3.5 to 4.5 and a pAg of from 5.5 to 8.0 and (b) from 1 to 10 percent of total silver used in forming said photographically useful emulsion in the form of silver halide grain nuclei containing bromide to promote {100} tabular grain growth, (2) adjusting pH to 5.0 to 6.5 and creating a second silver halide grain population within the dispersing medium by completing addition of silver forming said photographically useful emulsion while adding halide ion to maintain a pAg in the range of from 5.5 to 8.0, the halide ion being greater than 50 mole percent chloride, based on silver, total volume of said photopraphically useful emulsion being limited to 0.7 to 2.0 liters per silver mole, and (3) thereafter increasing the temperature of the dispersing medium to 60 to 95° C. to ripen out grains of the second grain population, thereby growing the tabular grains having {100} major faces.

2. A process according to claim 1 wherein from 3 to 8 percent of the total silver is present during step (1).

3. A process according to claim 1 wherein pAg in steps (1) and (2) is maintained in a range of from 6.4 to 7.5.

4. A process according to claim 1 wherein the temperature in step (3) is in a range of from 65 to 85° C.

5. A process according to claim 1 wherein from 92 to 97 percent of total silver is introduced in step (2).

6. A process according to claim 1 wherein in step (3) vAg is maintained in the range of from 105 to 140 millivolts.

7. A process of precipitating a photographically useful emulsion containing silver halide grains comprised of bromide and at least 50 mole percent chloride, based on silver, with tabular grains having {100} major faces accounting for greater than 50 percent of total grain projected area, comprised of the steps of (1) providing in a reaction vessel at a temperature of from 35 to 50° C. an emulsion comprised of (a) an aqueous dispersing medium containing a gelatino-peptizer containing at least 40 micromoles of methionine per gram in the amount of 0.5 to 5 grams per mole of silver present at the conclusion of step (2) and having a pH of from 3.5 to 4.5 and a pAg of from 5.5 to 8.0 and (b) from 1 to 10 percent of total silver used in forming said photographically useful emulsion in the form of silver halide rain nuclei containing bromide to promote {100} tabular grain growth, (2) adding gelatino-peptizer containing less than 4 micromoles of methionine to bring the gelatino-peptizer concentration to 10 to 60 grams per mole of silver present at the conclusion of this step, adjusting pH to 5.0 to 6.5 and creating a second silver halide grain population within the dispersing medium by completing addition of silver forming the photographically useful emulsion while adding halide ion to maintain a pAg in the range of from 5.5 to 8.0, the halide ion being greater than 50 mole percent chloride, based on silver, total volume of said silver halide emulsion being limited to 0.7 to 2.0 liters per silver mole, and (3) thereafter increasing the temperature of the dispersing medium to 60 to 95° C. to ripen out grains of the second grain population, thereby growing the tabular grains having {100 } major faces.

8. A process according to claim 7 wherein in step (3) vAg is maintained in the range of from 120 to 140 millivolts.

* * * * *